US008992253B2

(12) United States Patent
McClellan et al.

(10) Patent No.: US 8,992,253 B2
(45) Date of Patent: Mar. 31, 2015

(54) ELECTRICAL CONNECTOR FOR TRANSMITTING DATA SIGNALS

(71) Applicant: Tyco Electronics Corporation, Berwyn, PA (US)

(72) Inventors: Justin Shane McClellan, Camp Hill, PA (US); Justin Pickel, Hummelstown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 85 days.

(21) Appl. No.: 13/943,414

(22) Filed: Jul. 16, 2013

(65) Prior Publication Data

US 2015/0024635 A1 Jan. 22, 2015

(51) Int. Cl.
*H01R 12/71* (2011.01)

(52) U.S. Cl.
CPC ..... *H01R 12/71* (2013.01)
USPC ..... 439/607.05

(58) Field of Classification Search
USPC ..... 439/607.05, 607.11, 607.06, 660; 361/813
See application file for complete search history.

(56) References Cited

U.S. PATENT DOCUMENTS 7,131,870 B2 * 11/2006 Whiteman et al. ..... 439/607.06
7,172,461 B2 * 2/2007 Davis et al. ..... 439/607.11
7,316,585 B2 1/2008 Smith et al.
7,566,247 B2 * 7/2009 Rothermel et al. ..... 439/607.05
7,722,401 B2 * 5/2010 Kirk et al. ..... 439/607.07
8,231,415 B2 * 7/2012 Johnescu et al. ..... 439/701
2006/0216969 A1 * 9/2006 Bright et al. ..... 439/79
2008/0246555 A1 * 10/2008 Kirk et al. ..... 333/125
2008/0248659 A1 * 10/2008 Cohen et al. ..... 439/59
2008/0248660 A1 * 10/2008 Kirk et al. ..... 439/68
2008/0316729 A1 * 12/2008 Rothermel et al. ..... 361/813
2009/0093158 A1 * 4/2009 McAlonis et al. ..... 439/610
2010/0240233 A1 * 9/2010 Johnescu et al. ..... 439/108
2011/0067237 A1 * 3/2011 Cohen et al. ..... 29/857
2012/0289095 A1 * 11/2012 Kirk ..... 439/660
2013/0217263 A1 * 8/2013 Pan ..... 439/607.07
2014/0273627 A1 * 9/2014 Cartier et al. ..... 439/607.11
2014/0273663 A1 * 9/2014 Cartier et al. ..... 439/692
2014/0329414 A1 * 11/2014 Cohen et al. ..... 439/629

* cited by examiner

*Primary Examiner* — Alexander Gilman

(57) ABSTRACT

Electrical connector including a conductor pair having first and second signal conductors extending through the connector body along respective paths between the mating and mounting sides. The first signal conductor has a height and a thickness taken transverse to a direction of the respective path and includes a flag segment and a base segment. The height of the first signal conductor along the flag segment is greater than the height of the first signal conductor along the base segment. The electrical connector also includes a dielectric body extending between the mating and mounting sides and surrounding the conductor pair. The dielectric body has a signal-control trench that extends along and exposes the flag segment to an air dielectric. The signal-control trench has a height that is measured along the height of the flag segment. The height of the signal-control trench is less than the height of the flag segment.

20 Claims, 6 Drawing Sheets

ELECTRICAL CONNECTOR FOR TRANSMITTING DATA SIGNALS

BACKGROUND OF THE INVENTION

The subject matter herein relates generally to an electrical connector having signal conductors for transmitting differential signals between electrical components that are communicatively coupled through the electrical connector.

Networking and telecommunication systems use electrical connectors to interconnect different components of the systems. For example, the interconnected electrical components may be a motherboard and a daughter card. The electrical connectors are configured to transmit differential signals (e.g., data signals) through multiple signal conductors between the interconnected components. As speed and performance demands of the systems increase, however, conventional electrical connectors are proving to be insufficient. For example, signal loss and signal degradation are challenging issues for some electrical connectors. There is also a demand to increase the density of signal conductors to increase throughput. Moreover, there has been a general trend for smaller electrical devices, including smaller electrical connectors. Increasing the density of signal conductors while also decreasing the size of the electrical connectors, however, renders it more difficult to improve the speed and performance of the electrical connectors.

Another issue that may arise when developing an electrical connector is referred to as skew. Skew can occur when signal conductors of a common differential pair extend through the electrical connector with different path lengths. For instance, some right-angle connectors may be arranged "in-column" such that the two signal conductors of a conductor pair substantially coincide within a common plane. Due to the right-angle configuration and the in-column arrangement, the signal conductors have different physical path lengths. As such, the signals propagating through the two signal conductors have different distances to travel.

Different solutions to the skew problem have been proposed. Skew may be addressed outside of the electrical connector within one of the electrical components (e.g., circuit board) that the electrical connector engages. However, skew can also be addressed within the electrical connector. For example, the path of what would be the shorter signal conductor may be redirected to effectively increase the physical path length. Intentionally increasing the physical path lengths of the signal conductors, however, may increase the size of the electrical connector or lead to other challenges with respect to signal loss and degradation. As another example, some known connectors have used air trenches in which a portion of the signal conductor is exposed to air within the connector. Other connectors have used signal conductors that have "flags." A flag is a portion of the signal conductor that has greater cross-sectional dimensions than another portion of the same signal conductor. However, it can be challenging to manufacture electrical connectors with air trenches or flags because even relatively small manufacturing tolerances can lead to a large change in skew.

Accordingly, there is a need for additional solutions for reducing or eliminating skew between signal conductors that are configured for differential signaling within an electrical connector.

BRIEF DESCRIPTION OF THE INVENTION

In one embodiment, an electrical connector is provided that includes a connector body having a mating side and a mounting side that are configured to engage respective electrical components. The electrical connector also includes a conductor pair having first and second signal conductors extending through the connector body along respective paths between the mating and mounting sides. The first signal conductor has a height and a thickness taken transverse to a direction of the respective path and includes a flag segment and a base segment. The height of the first signal conductor along the flag segment is greater than the height of the first signal conductor along the base segment. The electrical connector also includes a dielectric body extending between the mating and mounting sides and surrounding the conductor pair. The dielectric body has a signal-control trench that extends along and exposes the flag segment to an air dielectric within the signal-control trench. The signal-control trench has a height that is measured along the height of the flag segment. The height of the signal-control trench is less than the height of the flag segment.

In certain embodiments, the conductor pair is a first conductor pair and the dielectric body is a first dielectric body, wherein the electrical connector also includes a second conductor pair and a second dielectric body. The second conductor pair has first and second signal conductors that extend between the mating and mounting sides and are surrounded by the second dielectric body. Optionally, the second dielectric body may have a corresponding signal-control trench that exposes a portion of the corresponding first signal conductor of the second conductor pair. The signal-control trenches of the first and second dielectric bodies may have different lengths. Also optionally, the first and second conductor pairs may be arranged co-planar with respect to each other such that the first and second signal conductors of the first conductor pair and the first and second signal conductors of the second conductor pair substantially coincide along a common plane.

In another embodiment, an electrical connector is provided that includes a connector body having a mating side and a mounting side that are configured to engage respective electrical components. The electrical connector also includes a conductor pair having first and second signal conductors extending through the connector body along respective paths between the mating and mounting sides. The first signal conductor has a height and a thickness taken transverse to a direction of the respective path and includes a flag segment and a base segment. The height of the first signal conductor along the flag segment is greater than the height of the first signal conductor along the base segment. The first signal conductor has a broadside surface. The electrical connector also includes a dielectric body extending between the mating and mounting sides and surrounding the conductor pair. The dielectric body has a signal-control trench that extends along and exposes the broadside surface along the flag segment. The broadside surface has an exposed area that interfaces with an air dielectric of the signal-control trench and a covered area that is directly engaged to and covered by the dielectric body.

DETAILED DESCRIPTION OF THE INVENTION

Embodiments described herein include connector systems (e.g., communication systems) and electrical connectors that are configured to transmit data signals. The electrical connectors are configured to engage other electrical components of the systems. The electrical components may be, for example, other electrical connectors, circuit boards, or other components capable of transmitting data signals. In particular embodiments, the systems and the electrical connectors set forth herein are configured for high-speed signal transmission, such as 10 Gbps, 20 Gbps, or more. Embodiments may include pairs of signal conductors that are surrounded by one or more dielectric bodies. The dielectric body may hold the signal conductors. For example, a dielectric body may be an overmold that separates the signal conductor from adjacent signal conductors and/or other conductive material. The dielectric body may be shaped or formed to intimately engage one or more surfaces (hereinafter referred to as covered areas) but to also expose one or more other surfaces (hereinafter referred to as exposed areas). The amount of exposure may be predetermined in order to achieve a target electrical performance.

Figure 1:
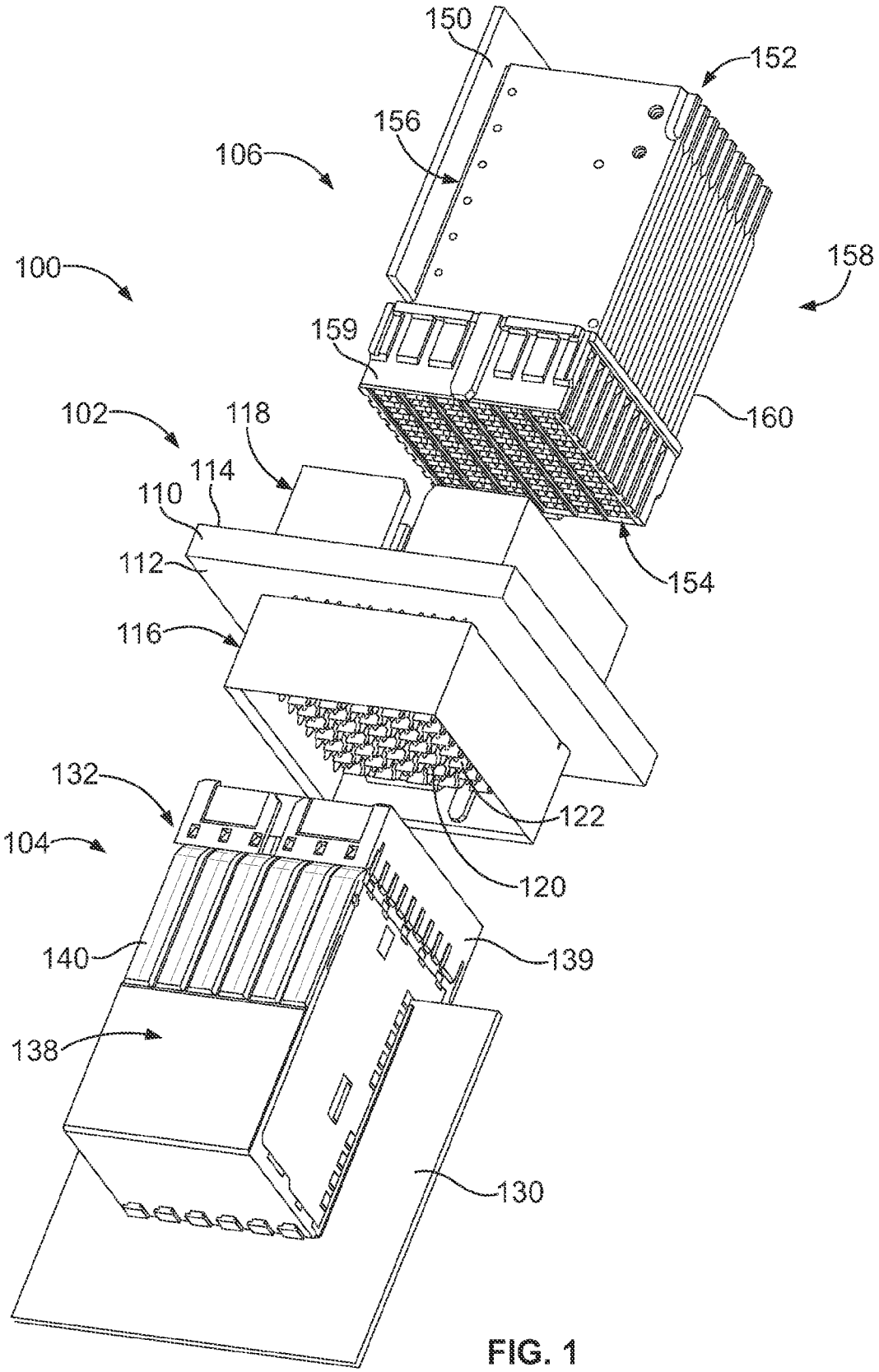
FIG. 1 is a perspective view of a connector system formed in accordance with one embodiment.

FIG. 1 is a perspective view of a connector system 100 formed in accordance with one embodiment. The connector system 100 includes a midplane assembly 102, a first connector assembly 104 configured to be coupled to one side of the midplane assembly 102, and a second connector assembly 106 configured to be connected to another side of the midplane assembly 102. The midplane assembly 102 is used to electrically connect the first and second connector assemblies 104, 106. Optionally, the first connector assembly 104 may be part of a daughter card and the second connector assembly 106 may be part of a backplane, or vice versa. In other embodiments, the connector assemblies 104, 106 may be part of a cabled backplane system. The first and second connector assemblies 104, 106 may also be line cards or switch cards. Alternatively, the connector assemblies 104, 106, with modification, may be directly connected without the use of the midplane assembly 102.

The midplane assembly 102 includes a midplane circuit board 110 having a first side 112 and second side 114 that face in opposite directions. The midplane assembly 102 includes a first header assembly 116 mounted to and extending from the first side 112 of the circuit board 110. The midplane assembly 102 includes a second header assembly 118 mounted to and extending from the second side 114 of the circuit board 110. The first and second header assemblies 116, 118 each include signal contacts 120 electrically connected to one another through the circuit board 110.

The midplane assembly 102 includes a plurality of signal pathways therethrough defined by the signal contacts 120 and conductive vias (not shown) that extend through the circuit board 110. Each signal pathway through the midplane assembly 102 is defined by a signal contact 120 of the first header assembly 116 and a signal contact 120 of the second header assembly 118, which may both be received in a common conductive via through the circuit board 110. In an exemplary embodiment, the signal pathways pass straight through the midplane assembly 102 along linear paths. Such a design of the circuit board 110 is less complex and less expensive to manufacture than a circuit board that routes traces between different vias to connect the first and second header assemblies 116, 118.

The first and second header assemblies 116, 118 include ground shields 122 that provide electrical shielding around corresponding signal contacts 120. In an exemplary embodiment, the signal contacts 120 may be pin-like and arranged in pairs configured to convey differential signals. The ground shields 122 may have panels or sides that peripherally surround a corresponding pair of the signal contacts 120. For example, the ground shields 122 may be C-shaped or L-shaped.

The first connector assembly 104 includes a first circuit board 130 and a first electrical connector 132 coupled to the circuit board 130. The electrical connector 132 is configured to be coupled to the first header assembly 116. The electrical connector 132 includes a connector body 138 that is formed from a shroud 139 and a plurality of contact modules 140 that are held by the shroud 139. The contact modules 140 are held in a stacked configuration generally parallel to one another. The contact modules 140 hold a plurality of signal contacts (not shown) that are electrically connected to the circuit board 130 and define signal pathways through the electrical connector 132. The signal contacts may be arranged in pairs carrying differential signals.

The second connector assembly 106 includes a second circuit board 150 and a second electrical connector 152 coupled to the circuit board 150. The electrical connector 152 is configured to be coupled to the second header assembly 118. The electrical connector 152 has a mating side 154 configured to be mated with the second header assembly 118. The electrical connector 152 has a mounting side 156 configured to be mated with the circuit board 150. In an exemplary embodiment, the mounting side 156 is oriented perpendicular with respect to the mating side 154. When the electrical connector 152 is coupled to the second header assembly 118, the circuit board 150 is oriented perpendicular with respect to the circuit board 110. The circuit board 150 is oriented perpendicular to the circuit board 130.

The electrical connector 152 includes a connector body 158 that is formed from a shroud 159 and a plurality of contact modules 160 that are held by the shroud 159. The connector body 158 includes the mating and mounting sides 154, 156. The contact modules 160 are held in a stacked configuration generally parallel to one another. The contact modules 160 hold a plurality of signal contacts 162 (shown in FIG. 2) that are electrically connected to the circuit board 150 and partially define signal pathways that extend through the electrical connector 152. The signal contacts 162 are configured to be electrically connected to the signal contacts 120 of the second header assembly 118. In an exemplary embodiment, the contact modules 160 provide electrical shielding for the signal contacts 162. The signal contacts 162 may be arranged in pairs carrying differential signals. In an exemplary embodiment, the contact modules 160 generally provide 360° shielding for each pair of signal contacts 162 along substantially the entire length of the signal contacts 162 between the mounting side 156 and the mating side 154. The shield structure of the contact modules 160 that provides the electrical shielding for the pairs of signal contacts 162 is electrically connected to the ground shields 122 of the second header assembly 118 and is electrically connected to a ground plane of the circuit board 150.

In the illustrated embodiment, the circuit board 130 is oriented generally horizontally. The contact modules 140 of the electrical connector 132 are oriented generally vertically. The circuit board 150 is oriented generally vertically. The contact modules 160 of the electrical connector 152 are oriented generally horizontally. The first connector assembly 104 and the second connector assembly 106 have an orthogonal orientation with respect to one another. The signal contacts within each differential pair, including the signal contacts of the electrical connector 132, the signal contacts 162 of the electrical connector 152, and the signal contacts 120, are all oriented generally horizontally. The contact modules 140 and/or 160 may be configured to be terminated to cables rather than circuit boards, with conductors of the cables terminated to corresponding conductors of the contact modules 140 and/or 160.

Figure 2:
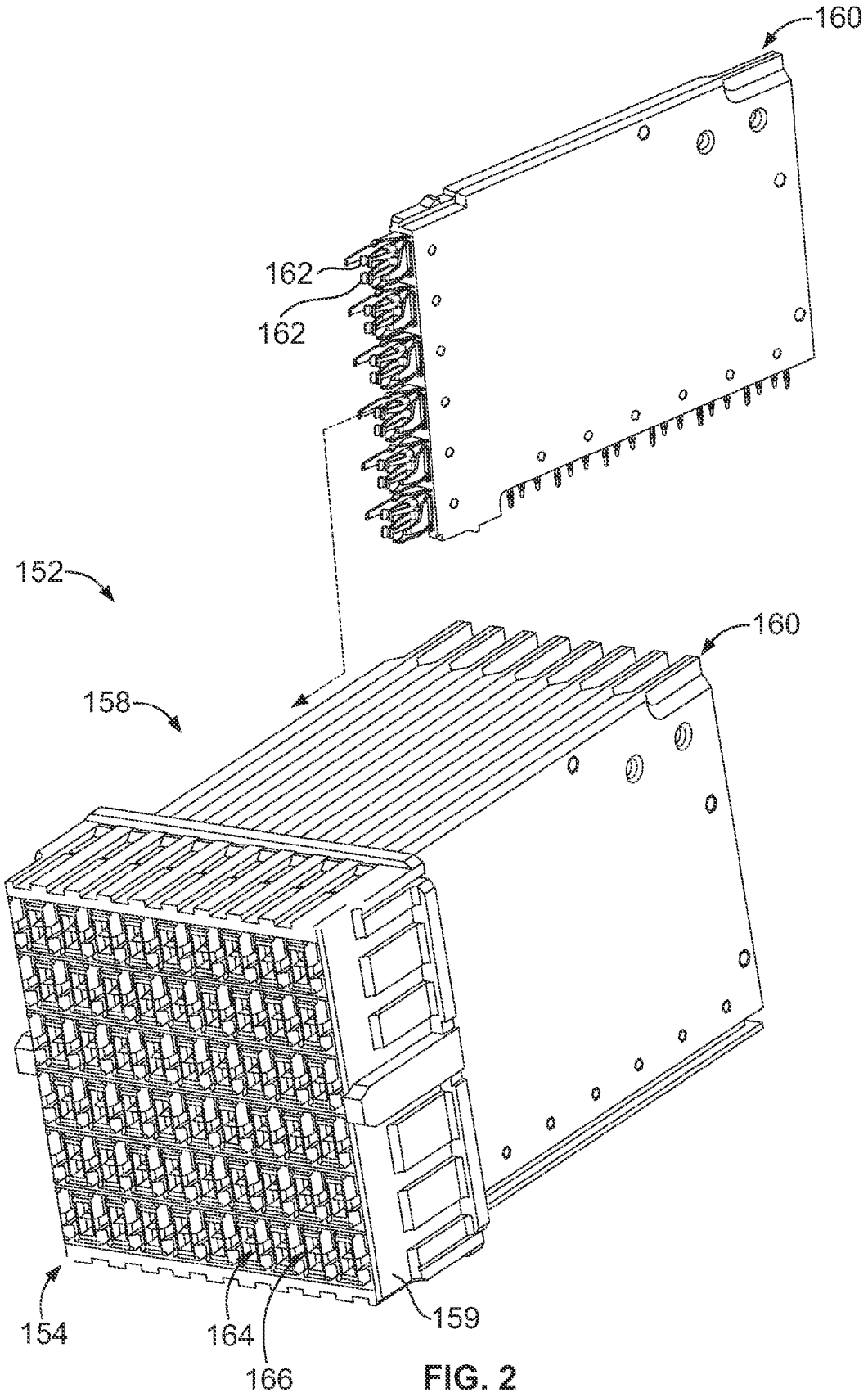
FIG. 2 is a front perspective view of an electrical connector formed in accordance with one embodiment.

FIG. 2 is a front perspective view of the electrical connector 152 and illustrates one of the contact modules 160, which is configured for loading into the shroud 159. The mating side 154 of the connector body 158 includes a plurality of signal contact openings 164 and a plurality of ground contact openings 166. The contact modules 160 and the shroud 159 collectively form the connector body 158. The signal contacts 162 are received in corresponding signal contact openings 164 of the shroud 159. The ground contact openings 166 of the shroud 159 are configured to receive corresponding ground shields 122 (FIG. 1) and grounding members, such as grounding beams of the contact modules 160.

Figure 3:
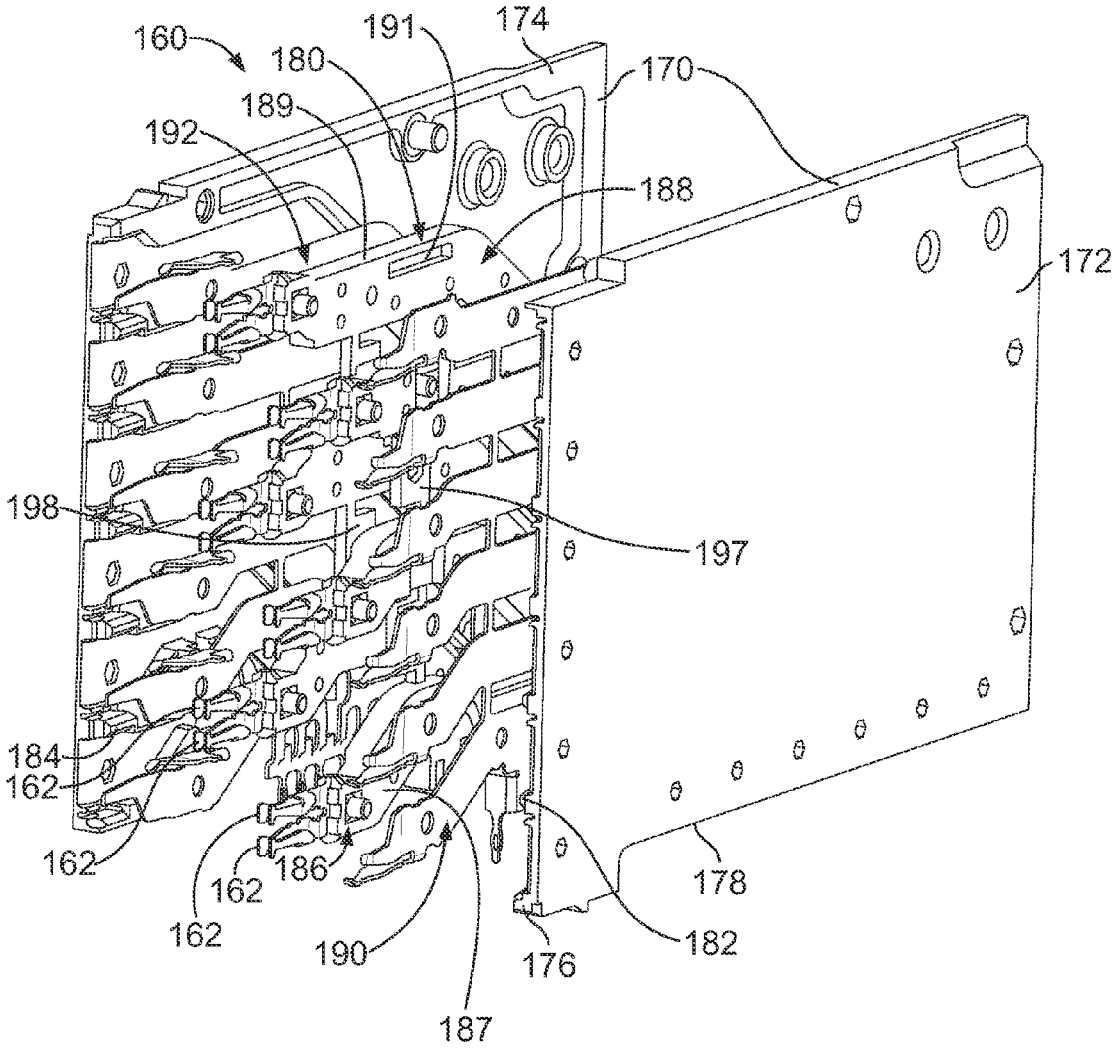
FIG. 3 is an exploded view of a contact module that may be used with the electrical connector.

FIG. 3 is an exploded view of an exemplary contact module 160. The contact module 160 includes a conductive holder 170, which in the illustrated embodiment includes a first holder member 172 and a second holder member 174 that are coupled together to form the conductive holder 170. The conductive holder 170 has a mating edge 176 and a mounting edge 178. In some embodiments, when the contact modules 160 are stacked side-by-side, such as shown in FIG. 2, the mounting edges 178 may collectively form or partially define the mounting side 156 (FIG. 1).

The holder members 172, 174 are fabricated from a conductive material. For example, the holder members 172, 174 may be die cast from a metal material. Alternatively, the holder members 172, 174 may be stamped and formed or may be fabricated from a plastic material that has been metalized or coated with a metallic layer. By having the holder members 172, 174 fabricated from a conductive material, the holder members 172, 174 may provide electrical shielding for the electrical connector 152 (FIG. 1). When the holder members 172, 174 are coupled together, the holder members 172, 174 define at least a portion of a shield structure to provide electrical shielding for signal pathways that extend through the electrical connector 152. The conductive holder 170 may be manufactured from a single piece rather than the two holder members 172, 174. In other embodiments, the holder 170 may not be conductive, but rather may rely on separate shields or may be unshielded.

The conductive holder 170 is configured to hold a frame assembly 180. In the illustrated embodiment, the frame assembly 180 includes first pathway assemblies 186 and second pathway assemblies 188. Each of the pathway assemblies 186, 188 includes a signal conductor 191 and respective dielectric bodies, 187, 189. Each of the signal conductors 191 of the pathway assemblies 186, 188 is electrically coupled to a corresponding signal contact 162. In some embodiments, the pathway assemblies 186, 188 may be manufactured by overmolding the corresponding signal conductors 191 and signal contacts 162 with a dielectric material thereby forming the respective dielectric bodies 187, 189. The pathway assemblies 186 may be coupled to one another through one or more joints 197, and the pathway assemblies 188 may be coupled to one another through one or more joints 198.

In some cases, the first and second pathway assemblies 186, 188 may be coupled to each other to form the frame assembly 180. When the frame assembly 180 is formed, one or more of the pathway assemblies 186 may be positioned between adjacent pathway assemblies 188 and/or one or more of the pathway assemblies 188 may be positioned between adjacent pathway assemblies 186. FIG. 3 shows three first pathway assemblies 186 and three second pathway assemblies 188. When the first and second pathway assemblies 186, 188 are coupled together to form the frame assembly 180, the frame assembly 180 has a total of six pathway assemblies that are co-planar with respect to each other (e.g., the pathway assemblies 186, 188 substantially coincide with a common plane).

Although certain embodiments may be formed through an overmolding process, other manufacturing processes may be utilized to form the pathway assemblies 186, 188 and the electrical connector 152. For example, each of the dielectric bodies 187, 189 may be constructed from separate dielectric shells. To construct the corresponding pathway assembly, the two dielectric shells may be coupled to each other with the corresponding signal conductor therebetween.

The holder members 172, 174 provide shielding around the frame assembly 180. The holder members 172, 174 include tabs 182, 184 that extend inward toward one another to extend into the frame assembly 180. The tabs 182, 184 define at least a portion of a shield structure that provides electrical shielding around the signal contacts 162. The tabs 182, 184 are configured to extend into the frame assembly 180 such that the tabs 182, 184 are positioned between pairs of the signal contacts 162 to provide shielding between the corresponding pairs of the signal contacts 162.

The holder members 172, 174 provide electrical shielding between and around respective pairs of signal pathways. A single signal pathway of the contact module 160 may include, for example, a signal contact 162 and the corresponding signal conductor 191 that is electrically coupled to the signal contact 162. The holder members 172, 174 provide shielding from electromagnetic interference (EMI) and/or radio frequency interference (RFI). The holder members 172, 174 may provide shielding from other types of interference as well. The holder members 172, 174 may prevent crosstalk between different pairs of signal contacts 162. The holder members 172, 174 may control electrical characteristics, such as impedance control, crosstalk control, and the like, of the signal contacts 162 and the signal conductors 191. The holder members 172, 174 may also provide shielding for the signal contacts 162 from adjacent contact modules.

In an exemplary embodiment, the contact module 160 includes a first ground shield 190 and a second ground shield 192 that provide shielding for the signal contacts 162. The ground shields 190, 192 make ground terminations to the ground shields 122 (FIG. 1) and the circuit board 150 (FIG. 1). In an exemplary embodiment, the ground shields 190, 192 are internal ground shields positioned within the conductive holder 170. The ground shields 190, 192 are inlaid within the conductive holder 170. For example, the first ground shield 190 is laid in the first holder member 172 and positioned between the first holder member 172 and the frame assembly 180. The second ground shield 192 is laid in the second holder member 174 and positioned between the second holder member 174 and the frame assembly 180. The dielectric bodies 187, 189 may be located between the ground shields 190, 192 when the contact module 160 is constructed.

Figure 4:
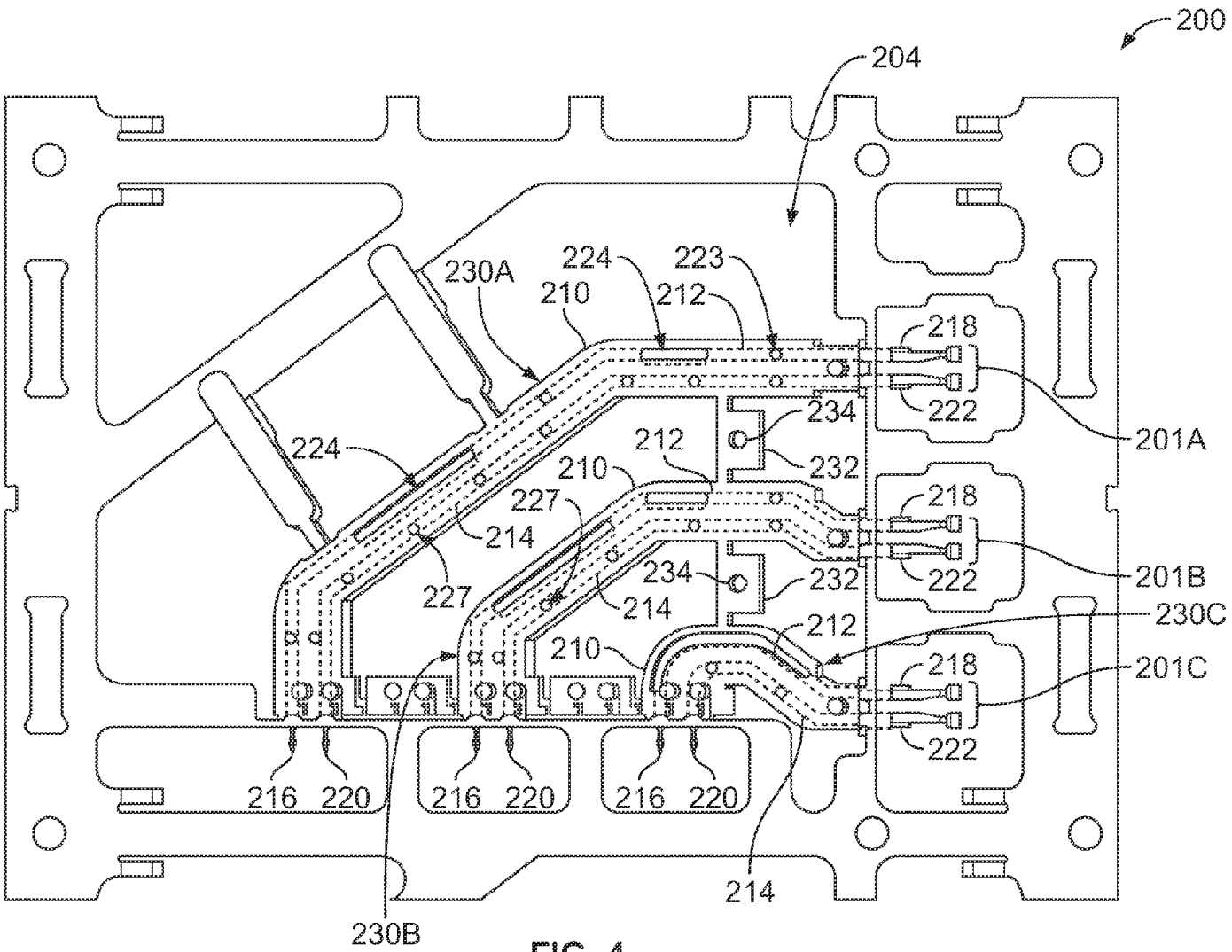
FIG. 4 is a side view of a leadframe that may be used to assemble an electrical connector in accordance with one embodiment.

FIG. 4 is a side view of an overmolded leadframe 200 formed in accordance with one embodiment that includes a plurality of pathway assemblies 230A-230C. The leadframe 200 and a similar leadframe may be used to form, with modification, the pathway assemblies 186 and the pathway assemblies 188, respectively, shown in FIG. 3. The leadframe 200 may be formed from sheet metal that is stamped and/or etched to define the various features of the leadframe 200. The sheet metal may be copper, copper alloy, or another metal that is capable of transmitting electrical current. The leadframe 200 may be overmolded with a dielectric material to form a frame structure 204. The frame structure 204 includes a plurality of dielectric bodies 210.

The leadframe 200 includes a plurality of conductor pairs 201A-201C. Each of the conductor pairs 201A-201C is surrounded by a corresponding dielectric body 210, and each of the conductor pairs 201A-201C includes a first signal conductor 212 and a second signal conductor 214 that extend proximate to each other along similarly-shaped paths. The first and second signal conductors 212, 214 are configured to transmit differential signals. As shown, the first and second signal conductors 212, 214 are indicated by dashed lines along the corresponding dielectric bodies 210. The first signal conductors 212 are also visible through corresponding air holes 223 and signal-control trenches 224, which are voids in the dielectric material of the corresponding dielectric bodies 210. The second signal conductors 214 are also visible through corresponding air holes 227 in the illustrated embodiment. In the illustrated embodiment, the signal conductors 212, 214 are shaped for a right-angle electrical connector, such as the electrical connectors 132, 152 (FIG. 1). In other embodiments, however, the signal conductors 212, 214 may be shaped for a vertical connector.

The signal conductors 212 have mounting and mating ends 216, 218 and extend lengthwise therebetween. The signal conductors 214 have mounting and mating ends 220, 222 and extend lengthwise therebetween. The mating ends 218, 222 may also be referred to as signal contacts, such as the signal contacts 162. As shown, the signal conductors 212, 214 of each conductor pair 201A-201C have different physical path lengths with respect to each other. The path lengths of the signal conductors 212 may be measured between corresponding mounting and mating ends 216, 218, and the path lengths of the signal conductors 214 may be measured between the corresponding mounting and mating ends 220, 222. In the illustrated embodiment, for each conductor pair 201A-201C, the physical path length of the corresponding signal conductor 212 is greater than the physical path length of the corresponding signal conductor 214 of the same conductor pair such that the signal conductors 212, 214 have an inherent skew. In FIG. 4, the leadframe 200 has a total of three (3) conductor pairs 201A-201C and a total of six (6) signal conductors 212, 214, but a different number of conductor pairs and signal conductors may be used in alternative embodiments.

The dielectric bodies 210 are elongated structures that surround the respective conductor pairs 201A-201C. For example, the dielectric bodies 210 may encase the signal conductors 212, 214 of the respective conductor pair. When the dielectric bodies 210 are molded or otherwise positioned to surround the signal conductors 212, 214 of the conductor pairs 201A-201C, the respective pathway assemblies 230A-230C are formed. The dielectric bodies 210 are configured to extend between mating and mounting sides of the electrical connector, such as the mating and mounting sides 154, 156 (FIG. 1) of the electrical connector 152. The mating ends 218, 222 are configured to be positioned proximate to the mating side so that the mating ends 218, 222 may directly engage respective signal contacts (not shown) of the mating connector, such as the header assembly 118 (FIG. 1). The mounting ends 216, 220 are configured to be positioned proximate to a mounting side so that the mounting ends 216, 220 may directly engage respective plated thru-holes (not shown) of a circuit board, such as the circuit board 150 (FIG. 1).

As described herein, the air holes 223 and signal-control trenches 224 may be configured to control an electrical performance of the corresponding pathway assembly. In some embodiments, the signal-control trenches 224 may be sized and shaped relative to the associated signal conductors 212 to accommodate skew that is formed by the path lengths of the signal conductors 212, 214 of the corresponding pathway assemblies 230A-230C. The air holes 223 and the signal-control trenches 224 may be formed during an overmolding process. For example, the leadframe 200 may be positioned within a shaping mold (not shown) and a liquid dielectric material may be injected into the shaping mold. The shaping mold may include projections that directly engage (e.g., press against) surfaces of the signal conductors 212, 214 so that the air holes 223 and the signal-control trenches 224 exist after the dielectric material cures or sets. In an alternative manufacturing method, each of the dielectric bodies 210 may completely surround the respective conductor pairs 201A-201C such that the signal conductors are not exposed to the surrounding environment. Subsequently, the dielectric bodies 210 may be removed (e.g., etched) to expose surfaces of the signal conductors 212, 214.

The pathway assemblies 230A-230C may be similar to the pathway assemblies 186, 188 (FIG. 3). For example, adjacent pathway assemblies 230A, 230B or 230B, 230C may be coupled to each other through a joint 232 that extends across and directly couples the two pathway assemblies. The joints 232 may be similar to the joints 197, 198 described above with respect to FIG. 3. In some embodiments, the pathway assemblies 230A-230C form only a part of one column of pathway assemblies. For example, the three pathway assemblies 230A-230C may be inter-nested with two or three other pathway assemblies from another leadframe. For example, another pathway assembly may be positioned in the space between the adjacent pathway assemblies 230A, 230B, or another pathway assembly may be positioned in the space between the adjacent pathway assemblies 230B, 230C. In some embodiments, the joints 232 may include respective holes or openings 234. The holes 234 may receive posts from another overmolded leadframe 200 to join the overmolded leadframes.

Figure 5:
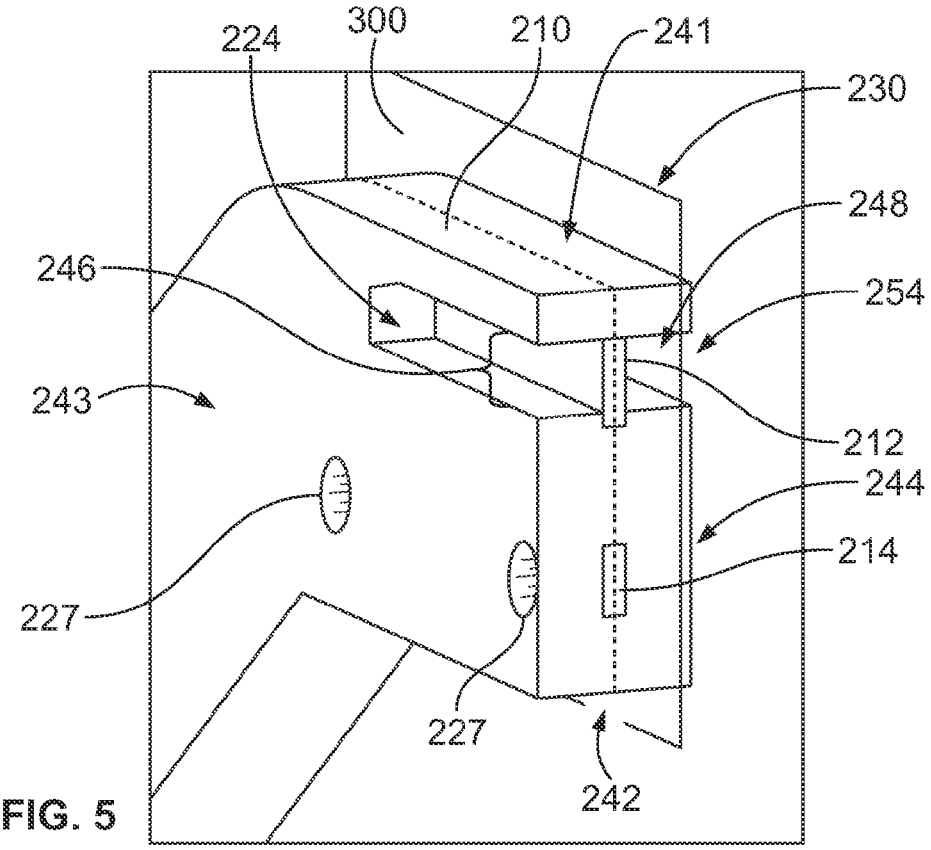
FIG. 5 is a perspective cross-section of a pathway assembly of the leadframe that may be used by the electrical connector.

FIG. 5 is a perspective view of a cross-section of one of the pathway assemblies 230. The dielectric body 210 includes a plurality of body surfaces 241-244 including opposite edge surfaces 241, 242 and opposite side surfaces 243, 244. The dielectric body 210 surrounds the signal conductors 212, 214. In the illustrated embodiment, the dielectric body 210 is shaped to expose surfaces of the signal conductors 212, 214. For example, the signal-control trench 224 and a signal-control trench 254 may expose corresponding portions of the signal conductor 212 to air dielectrics 246 that are defined by the corresponding signal-control trench.

The air holes 227 may also expose portions of the signal conductor 214 to an air dielectric. Although not shown, there may be additional air holes along the side surface 244 that expose the signal conductor 214 and/or signal conductor 212. The signal-control trenches 224, 254 and the air holes 227 are cavities or voids in the dielectric body 210. In particular embodiments, the signal-control trenches 224, 254 and the air holes 227 expose the signal conductors 212, 214 to air within a contact module, such as the contact module 160 (FIG. 1), that defines a portion of the connector body. For example, the dielectric body 210 may be sandwiched between holder members, such as the first and second holder members 172, 174 (FIG. 3).

As shown, the signal-control trenches 224, 254 are directly opposite each other such that the signal-control trenches 224, 254 may constitute a single window 248 that would extend entirely through the dielectric body 210 and the side surfaces 243, 244 if it were not for the signal conductor 212. In other embodiments, only one of the signal-control trenches 224, 254 may be extend along the signal conductor 212. In the illustrated embodiment, the side surfaces 243, 244 and the edge surfaces 241, 242 define a generally rectangular or block-shaped cross-section of the dielectric body 210, except for portions of the dielectric body 210 that include the signal-control trenches 224, 254 and the air holes 223 (FIG. 4) or 227.

The signal conductors 212, 214 may have substantially rectangular cross-sections that are formed when, for example, the sheet material is stamped to form the leadframe 200 (FIG. 4). Accordingly, the signal conductors 212, 214 of one conductor pair may substantially coincide with a common plane 300. In some embodiments, the electrical connectors set forth herein may include "in-column" conductor pairs, wherein each of the signal conductors 212, 214 of the conductor pairs substantially coincide with the common plane 300. For example, the conductor pairs 201A-201C may substantially coincide with the common plane 300 in some embodiments.

Figure 6:
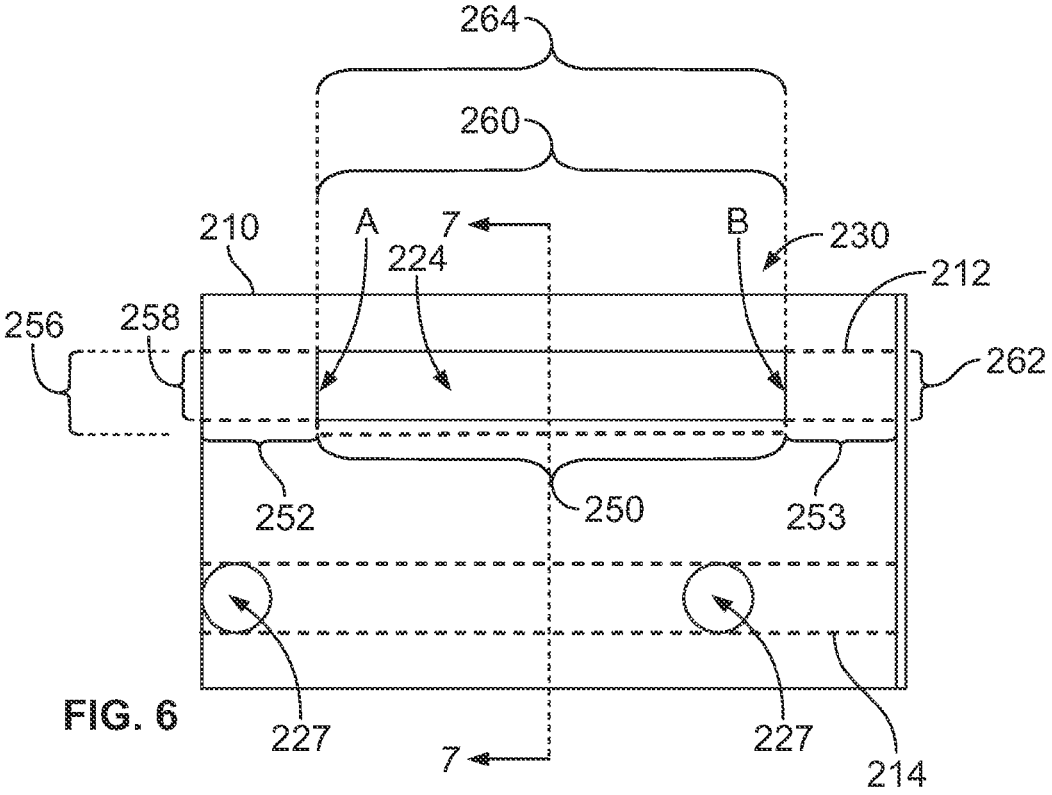
FIG. 6 is a side view of a portion of the pathway assembly.

FIG. 6 is a side view of an enlarged portion of the pathway assembly 230. The signal conductor 212 is shown through the signal-control trench 224 in the dielectric body 210 and also by phantom lines. Likewise, the signal conductor 214 is shown through the air holes 227 in the dielectric body 210 and also by phantom lines. As shown by the phantom lines, the signal conductor 212 may include at least one flag segment 250 and first and second base segments 252, 253 that the flag segment 250 extends between and joins. Embodiments set forth herein may include signal conductors having segments with different cross-sectional dimensions. For example, the signal conductor 212 has a height 256 along the flag segment 250 and a second height 258 along the base segments 252, 253. The height 256 is greater than the height 258.

Also shown in FIG. 6, the signal-control trench 224 has a length 260 and a height 262. The height 262 is measured along the height 256 of the flag segment 250 (e.g., measured along a common axis so that the values can be compared). The heights 262, 256 may be measured along the common plane 300 (FIG. 5) in the same direction that is transverse to the path of the signal conductor 212. More specifically, the height 256 may be measured between opposite edge surfaces 271, 272 (shown in FIG. 7) of the signal conductor 212, and the height 262 may be measured between opposite interior surfaces of the signal trench 224, such as interior surfaces 275, 276 (shown in FIG. 7). In particular embodiments, the height 262 of the signal-control trench 224 is shorter than the height 256 of the flag segment 250. The height 262 may be substantially equal to the height 258 of the base segments 252, 253.

The flag segment 250 has a length 264, which may be measured along the length 260 of the signal-control trench 224. In the illustrated embodiment, the length 264 is equal to the length 260 of the signal-control trench 224. Also shown, the length 264 of the flag segment 250 directly overlaps with the length 260 of the signal-control trench 224. More specifically, the flag segment 250 may begin immediately at a beginning of the signal-control trench 224 at point A in FIG. 6, and the flag segment 250 may end immediately with the signal-control trench 224 at point B in FIG. 6.

Figure 7:
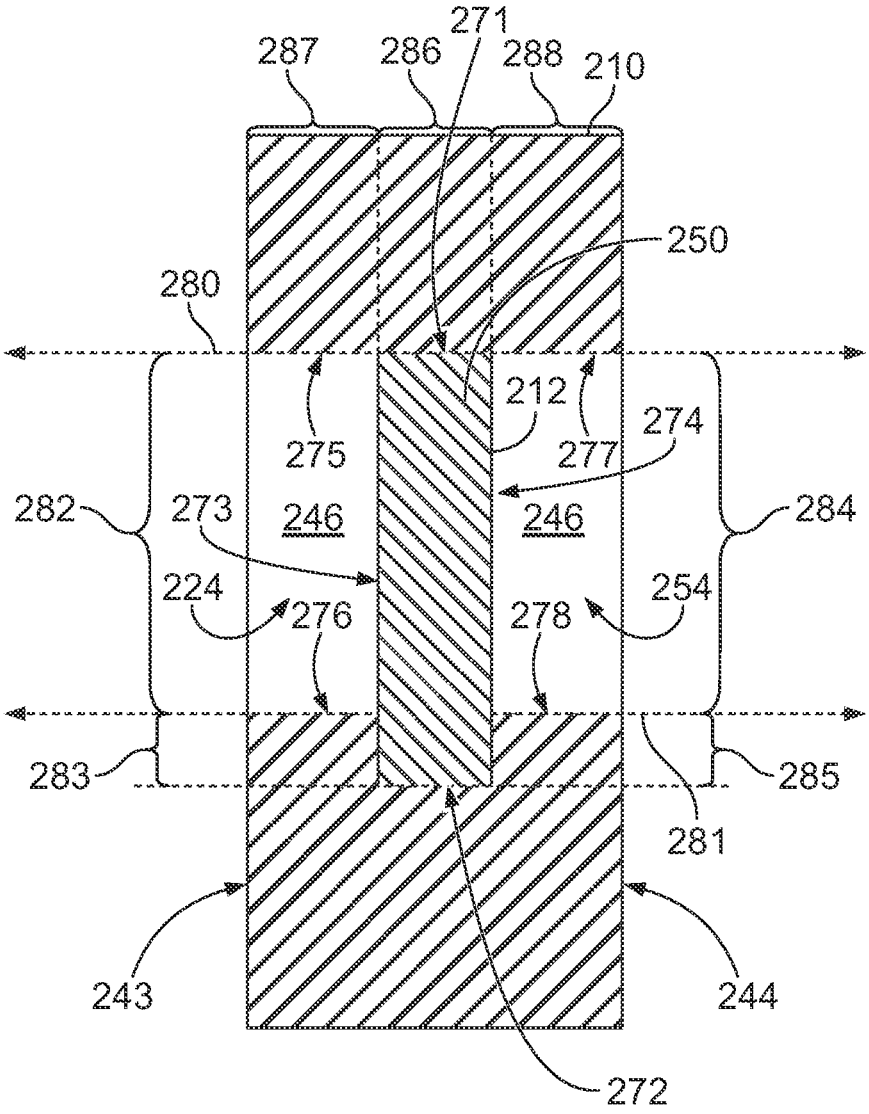
FIG. 7 is a cross-section taken along the line 7-7 in FIG. 6 of the pathway assembly.

FIG. 7 is an enlarged cross-section of the dielectric body 210 and the signal conductor 212 at the flag segment 250 taken transverse to the path of the signal conductor 212. As shown, the signal conductor 212 includes conductor surfaces 271-274 including opposite edge surfaces 271, 272 and opposite broadside surfaces 273, 274. The edge surfaces 271, 272 may be directly engaged by the dielectric body 210. In some embodiments, the edge surfaces 271, 272 may be stamped edges that are formed when the leadframe 200 (FIG. 4) is stamped from a conductive sheet of material. The signal conductor 212 has a thickness 286 along the flag segment 250 that is measured between the opposite broadside surfaces 273, 274. As shown, the broadside surfaces 273, 274 are located respective depths 287, 288 from the respective side surfaces 243, 244.

The signal-control trench 224 is defined by opposite interior surfaces 275, 276 and the broadside surface 273 that extends between the interior surfaces 275, 276. The signal-control trench 254 is defined by opposite interior surfaces 277, 278 and the broadside surface 274 that extends between the interior surfaces 277, 278. As shown, the interior surfaces 275, 277 and the edge surface 271 may substantially coincide with a surface plane 280. In the illustrated embodiment, the interior surfaces 276, 278 substantially coincide with a surface plane 281.

The edge surface 272, however, is not co-planar with the interior surfaces 276, 278 and does not coincide with the surface plane 281. Instead, the edge surface 272 may be embedded within the dielectric body 210 such that the edge surface 272 directly engages the dielectric body 210 and proximate portions of the broadside surfaces 273, 274 also directly engage the dielectric body 210. As used herein, elements may "directly engage" each other when surfaces of the elements intimately engage each other along an interface.

As such, only a portion of a total surface area of the broadside surface 273 is exposed to a corresponding air dielectric 246, and only a portion of a total surface area of the broadside surface 274 is exposed to a corresponding air dielectric 246. More specifically, the broadside surface 273 includes an exposed area 282 and a covered area 283. The broadside surface 274 includes an exposed area 284 and a covered area 285. The covered areas 283, 285 directly engage the dielectric body 210 such that the covered areas 283, 285 are covered by the dielectric body 210.

The various dimensions of the signal conductor 212 and the dielectric body 210 may be configured to achieve a target electrical performance. For example, the dimensions of the exposed areas 282, 284; the dimensions of the covered areas 283, 285; the dimensions of the interior surfaces 275, 276 and 277, 278; the depths 287, 288; and the thickness 286 of the signal conductor 212 may be configured to achieve a target electrical performance. More specifically, the dimensions may be configured to accommodate for the skew caused by the different path lengths of the signal conductors 212, 214 (FIG. 4). In the illustrated embodiment, the exposed areas 282, 284 have substantially identical sizes and shapes, and the covered areas 283, 285 have substantially identical sizes and shapes. In alternative embodiments, however, the exposed areas 282, 284 and the covered areas 283, 285 may have other shapes to achieve the target electrical performance.

By way of example only, electrical connectors set forth herein may be configured to have an approximate impedance, such as 100 Ohm or 85 Ohm. The height 256 (FIG. 6) of the flag segment 250 may be two times (2×) the height 262 (FIG. 6) of the signal-control trench 224. In certain embodiments, the height 256 may be about 1.5× the height 262 or, more specifically, about 1.2× the height 262. Various values for the dimensions may be used. For example, the height 256 may be between about 1.50 mm to about 0.50 mm. In particular embodiments, the height 256 may be about 0.75 mm to about 0.45 mm or, more specifically, about 0.65 mm to about 0.55 mm. The height 262 may be between about 1.00 mm to about 0.25 mm. In particular embodiments, the height 262 may be about 0.60 mm to about 0.30 mm or, more specifically, about 0.55 mm to about 0.45 mm. The electrical connectors set forth herein may achieve the target electrical performance while having critical dimensions that fall within a normal range of manufacturing tolerances. In other words, the target electrical performance may be achieved despite the manufacturing tolerances.

Returning to FIG. 4, the dielectric bodies 210 of the pathway assemblies 230A-230C have a total of five (5) signal-control trenches 224. In some embodiments, the pathway assemblies 230A-230C may have a different number of signal-control trenches 224 with respect to other pathway assemblies. For instance, each of the pathway assemblies 230A, 230B has two signal-control trenches 224, but the pathway assembly 230C has only a single signal-control trench 224. Also shown, the signal-control trenches 224 of the different pathway assemblies 230A-230C may have different lengths. For example, the length of the signal-control trench 224 for the pathway assembly 230C is greater than either of the lengths of the signal-control trenches 224 for the pathway assembly 230A.

The following describes embodiments and/or aspects that are supported by the above description. The following refers to exemplary elements that were described and illustrated with respect to FIGS. 1-7. However, it is understood that many other embodiments and modifications within the spirit and scope of the claims will be apparent to those of skill in the art upon reviewing the above description.

For example, in one embodiment, an electrical connector (e.g. 152) is provided. The electrical connector may include a connector body (e.g., 158) having a mating side (e.g., 154) and a mounting side (e.g., 156) that are configured to engage respective electrical components. The electrical connector may also include a conductor pair (e.g., 201A-201C) including first and second signal conductors (e.g., 212, 214) that extend through the connector body along respective paths between the mating and mounting sides. The first signal conductor has a height and a thickness taken transverse to a direction of the respective path and includes a flag segment (e.g., 250) and a base segment (e.g., 252), wherein the height (e.g., 256) of the first signal conductor along the flag segment is greater than the height (e.g., 262) of the first signal conductor along the base segment. The electrical connector also includes a dielectric body (e.g., 210) extending between the mating and mounting sides and surrounding the conduct or pair. The dielectric body has a signal-control trench (e.g., 224) that extends along and exposes the flag segment to an air dielectric (e.g., 246) within the signal-control trench. The signal-control trench has a height (e.g., 262) that is measured along the height of the flag segment. The height of the signal-control trench is less than the height of the flag segment.

In some embodiments, the first signal conductor includes opposite edge surfaces (e.g., 271, 272) that extend along the thickness (e.g., 286) of the first signal conductor, and opposite broadside surfaces (e.g., 273, 274) that extend along the height of the first signal conductor. The signal-control trench may expose at least one of the broadside surfaces to the air dielectric. Also, the at least one broadside surface (e.g., 273, 274) may have an exposed area (e.g., 282) that interfaces with the air dielectric and a covered area (e.g., 283) that is directly engaged to and covered by the dielectric body (210).

As used herein, an element or step recited in the singular and proceeded with the word "a" or "an" should be understood as not excluding plural of said elements or steps, unless such exclusion is explicitly stated. Furthermore, references to "one embodiment" or "an embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a connector body having a mating side and a mounting side that are configured to engage respective electrical components;

a conductor pair including first and second signal conductors extending through the connector body along respective paths between the mating and mounting sides, the first signal conductor having a height and a thickness taken transverse to a direction of the respective path and including a flag segment and a base segment, wherein the height of the first signal conductor along the flag segment is greater than the height of the first signal conductor along the base segment; and a dielectric body extending between the mating and mounting sides and surrounding the conductor pair, the dielectric body having a signal-control trench that extends along and exposes the flag segment to an air dielectric within the signal-control trench, the signal-control trench having a height that is measured along the height of the flag segment, the height of the signal-control trench being less than the height of the flag segment.

2. The electrical connector of claim 1, wherein the first signal conductor includes opposite edge surfaces that extend along the thickness of the first signal conductor and opposite broadside surfaces that extend along the height of the first signal conductor, the signal-control trench exposing at least one of the broadside surfaces to the air dielectric.

3. The electrical connector of claim 2, wherein the at least one broadside surface has an exposed area that interfaces with the air dielectric and a covered area that is directly engaged to and covered by the dielectric body.

4. The electrical connector of claim 2, wherein the signal-control trench is a first signal-control trench and the dielectric body includes a second signal-control trench, each of the first and second signal-control trenches exposing a different one of the broadside surfaces.

5. The electrical connector of claim 2, wherein each of the edge surfaces is directly engaged by the dielectric body.

6. The electrical connector of claim 1, wherein the mating and mounting sides face in mating and mounting directions perpendicular to each other.

7. The electrical connector of claim 1, wherein the first and second signal conductors having different physical path lengths.

8. The electrical connector of claim 1, wherein the conductor pair is a first conductor pair and the dielectric body is a first dielectric body, the electrical connector further comprising a second conductor pair and a second dielectric body, the second conductor pair including first and second signal conductors that extend between the mating and mounting sides and are surrounded by the second dielectric body.

9. The electrical connector of claim 8, wherein the second dielectric body has a corresponding signal-control trench that exposes a portion of the corresponding first signal conductor of the second conductor pair, the signal-control trenches of the first and second dielectric bodies having different lengths.

10. The electrical connector of claim 8, wherein the first and second conductor pairs are arranged co-planar with respect to each other such that the first and second signal conductors of the first conductor pair and the first and second signal conductors of the second conductor pair substantially coincide along a common plane.

11. The electrical connector of claim 1, further comprising a circuit board, the mounting side of the connector body and the first and second signal conductors being directly engaged to the circuit board.

12. The electrical connector of claim 1, wherein the electrical connector is a high-speed connector configured to transmit data signals.

13. An electrical connector comprising:

a connector body having a mating side and a mounting side that are configured to engage respective electrical components;

a conductor pair including first and second signal conductors extending through the connector body along respective paths between the mating and mounting sides, the first signal conductor having a height and a thickness taken transverse to a direction of the respective path and including a flag segment and a base segment, wherein the height of the first signal conductor along the flag segment is greater than the height of the first signal conductor along the base segment, the first signal conductor having a broadside surface; and a dielectric body extending between the mating and mounting sides and surrounding the conductor pair, the dielectric body having a signal-control trench that extends along and exposes the broadside surface along the flag segment, the broadside surface having an exposed area that interfaces with an air dielectric of the signal-control trench and a covered area that is directly engaged to and covered by the dielectric body.

14. The electrical connector of claim 13, wherein the signal-control trench has a height that is measured along the height of the first signal conductor along the flag segment, the height of the signal-control trench being less than the height of the first signal conductor along the flag segment.

15. The electrical connector of claim 13, wherein the first signal conductor has opposite edges surfaces with the broadside surface extending between the edge surfaces, each of the edge surfaces directly engaging and being covered by the dielectric body.

16. The electrical connector of claim 13, wherein the mating and mounting sides face in mating and mounting directions perpendicular to each other.

17. The electrical connector of claim 13, wherein the first and second signal conductors having different path lengths.

18. The electrical connector of claim 13, wherein the conductor pair is a first conductor pair and the dielectric body is a first dielectric body, the electrical connector further comprising a second conductor pair and a second dielectric body, the second conductor pair including first and second signal conductors that extend between the mating and mounting sides and are surrounded by the second dielectric body.

19. The electrical connector of claim 18, wherein the second dielectric body has a corresponding signal-control trench that exposes a portion of the corresponding first signal conductor of the second conductor pair, the signal-control trenches of the first and second dielectric bodies having different physical lengths.

20. The electrical connector of claim 18, wherein the first and second conductor pairs are arranged co-planar with respect to each other such that the first and second signal conductors of the first conductor pair and the first and second signal conductors of the second signal conductor substantially coincide along a common plane.

* * * * *